United States Patent [19]

Lew

[11] Patent Number: 5,035,432

[45] Date of Patent: Jul. 30, 1991

[54] GOLF GAME

[76] Inventor: Garland Lew, Wiltronic Manufacturers Ltd., 1, Wong Chuk Yeung Street, Fotan, Shatin, Hong Kong

[21] Appl. No.: 564,889

[22] Filed: Aug. 9, 1990

[30] Foreign Application Priority Data

Aug. 16, 1989 [GB] United Kingdom ..... 8918715

[51] Int. Cl.[5] ..... A63B 69/36; H01H 25/00

[52] U.S. Cl. ..... 273/176 FA; 273/185 C; 273/148 B; 200/5 A; 200/339

[58] Field of Search ..... 273/176 F, 176 FA, 176 FB, 273/184 B, 185 C, 148 B

[56] References Cited

U.S. PATENT DOCUMENTS 3,031,889 5/1962 Magazanik et al. ..... 273/185 C
4,687,200 8/1987 Shirai ..... 273/148 B
4,861,035 8/1989 Page ..... 273/184 B
4,925,189 5/1990 Braeunig ..... 273/148 B

*Primary Examiner*—George J. Marlo
*Attorney, Agent, or Firm*—Weingarten, Schurgin, Gagnebin & Hayes

[57] ABSTRACT

A golf game comprises a base which is formed as a ramp covered with a carpet to simulate the green of a golf course. A ball is tethered by means of cord to the control stick of a joystick controller. A "pull-to-close" switch is incorporated in the cord so that data on the position of the control stick when the cord is taut can be fed to a computer in order to calculate the trajectory and distance of a drive. Putting practice can be obtained by use of a free ball which is putted into a hole formed in the base and provided with a microswitch which closes when the ball enters the hole. A computer program for game play or practice is described.

13 Claims, 4 Drawing Sheets

GOLF GAME

TECHNICAL FIELD

The present invention relates to a computer game machine for simulating or allowing practice of the game of golf.

BACKGROUND ART

There is a great demand amongst golfers for game practice. Various devices are available on the market to allow the golfer to practice his putting. These comprise a simulated golf hole and sometimes a simulated green. However, in order to practice driving, it is normally necessary for the golfer to go to a golf course or driving range. When practicing on a driving range the golfer can only determine his performance by sighting the ball he has hit and noting the distance that it travels. There is no provision for any feedback of information about its velocity or precise trajectory.

The provision of a facility for practice in a game format without the need for the golfer to travel to a golf course presents a first technical problem which is solved by the machine of the present invention.

The machine can also be used by a golfer to provide him with information about the trajectory of a golf ball he has struck.

BRIEF DESCRIPTION OF THE DRAWINGS

A computer game machine embodying the present invention will now be described, by way of example only, with reference to the accompanying diagrammatic drawings, in which.

BEST MODE FOR CARRYING OUT THE INVENTION

Figure 1:
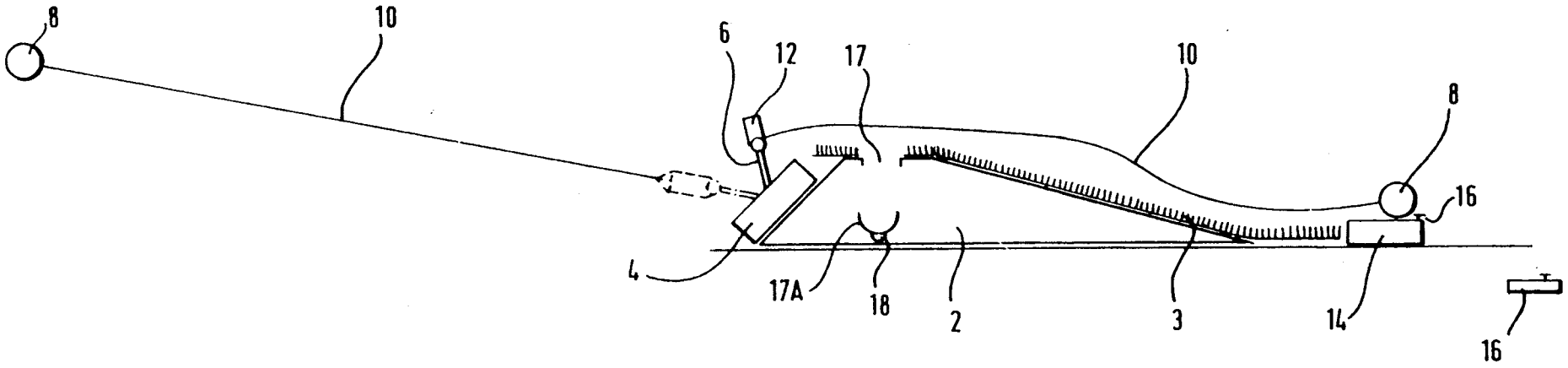
FIG. 1 is a diagrammatic side view of the components of the machine showing the golf ball in its start position on the right hand side of the drawing and during flight on the left hand side of the drawing.
Figure 3:
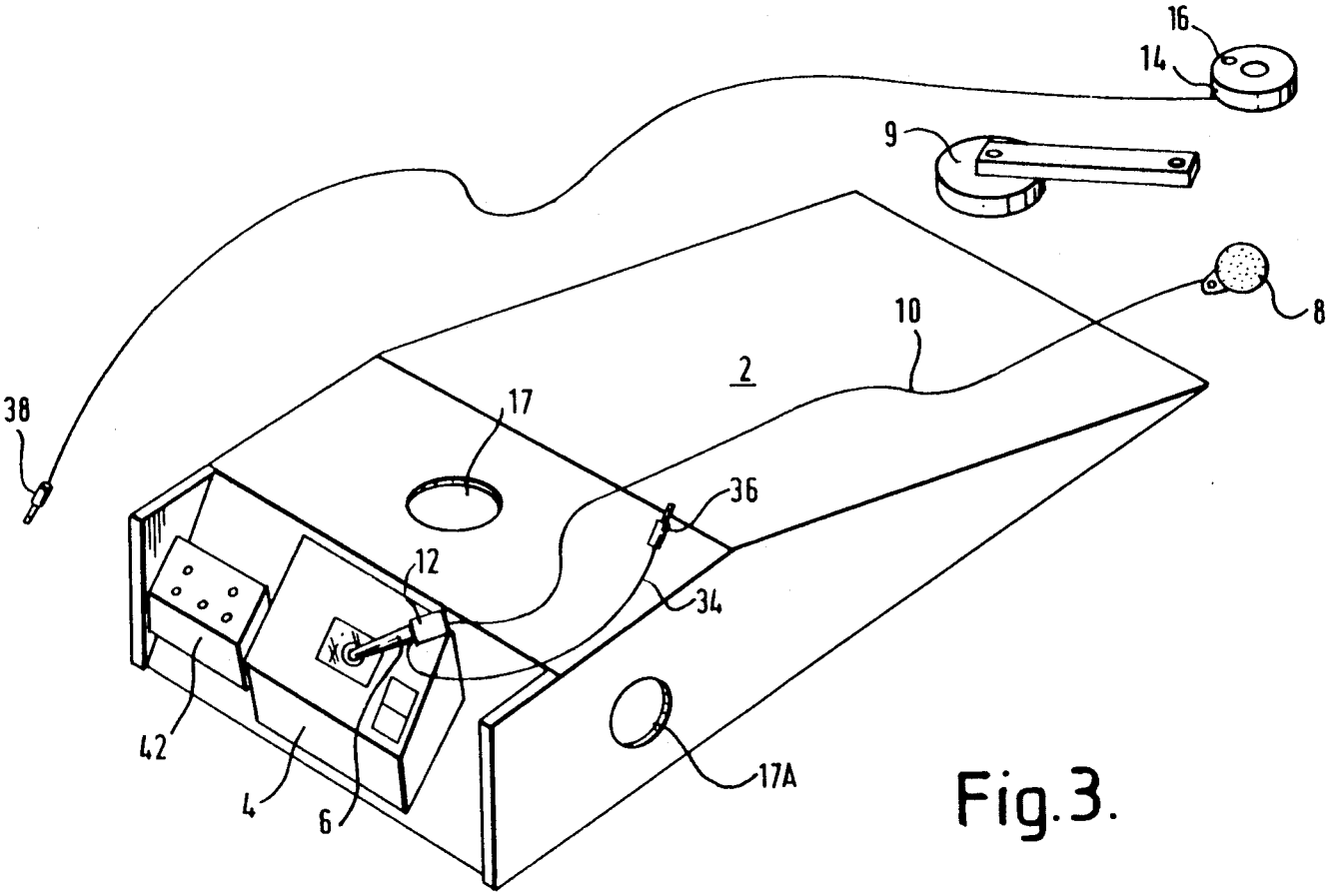
FIG. 3 is a perspective view of parts of the machine of FIG. 1.

The golf game machine is primarily intended for arcade game use though it may also be provided for private use or use in a golf club as a training facility. The machine has two main components, a base 2 to simulate a green on a golf course. and a computer (not shown). As illustrated in FIGS. 1 and 3, the base 2 comprises a housing in the form of a ramp which is covered with a grass carpet 3 to provide resistance to the rolling of the golf ball during putting. The base 2 also supports a joystick controller 4 having a control stick 6 to which a golf ball 8 is connected by means of a cord 10. The joystick controller 4 may be any design of joystick which provides an output compatible with the computer used in the game. Such joysticks are commonly used for interfacing with a computer running game programs and will not therefore be described in detail. The essential facilities of the joystick controller for the purposes of the present machine are that the output from the controller 4 should represent the orientation of the control stick 6. The stick 6 is moved by the cord 10 so that when the cord is taut as shown in the left hand side of FIG. 1 the stick is pointing directly towards the ball.

The golf ball 8 is modified by the addition of a tag to which the cord 10 is tied. A ball stand or tee 9 stands alone. A tethered tee may also be employed and is advantageous where the machine is to be used by members of the public as it prevents loss of the tee. The length of the cord 10 determines the maximum height and length of the drive of the ball and is set so that the cord will in most circumstances be pulled taut at some point during the drive without unnecessarily restricting the normal trajectory of the ball. The cord includes a "pull-to close" contact switch 12, the design of which is shown in more detail in FIG. 2. The contacts of the switch are closed when the cord is taut in order to provide an input to the computer which will be used during playing of the game as will be described in more detail with reference to FIG. 4. A game start button 14 is provided to support the tee 9 or the ball 8 directly at the start of game play. The button 14 comprises a switch which is closed or is triggered by light at the removal of the ball on it to provide a 'start' signal to the computer. The button 14 may comprise a press button switch which is closed when the weight (i.e. the ball) on it is removed. A further button 16 is provided in order to allow the game player to interact with the computer program as will be described in more detail with reference to FIG. 4.

The base 2 is provided with a cut out 17 at the top of the ramp in order to simulate a hole. In the base of this hole there is a trough 17A with a microswitch 18 which provides a signal to the computer when the switch is closed by contact with the ball when it is holed.

Figure 2:
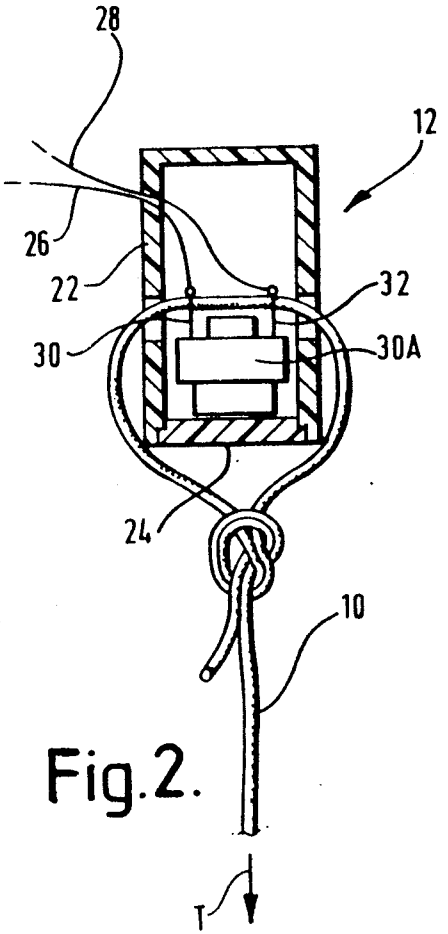
FIG. 2 is a cross-sectional view through a switch used in the machine of FIG. 1.

The 'pull-to-close' contact switch 12 will now be described in more detail with reference to FIG. 2. The switch comprises a plastic housing 22 and a plastic cap 24. The two-parts 22, 24 are welded together to define a closed cylindrical housing. The part 22 of the housing is fixedly connected directly to the control stick 6 of the joystick controller 4. Part 22 may be connected indirectly to the control stick 6 by a further cord connected by its one end to the part 22 and by its other end to the control stick 6. A push-button 30A is fixed on the inside of part 24. Two conductors 26, 28 are connected to the legs 30, 32 of part 30A. A fixed knot passing through two holes (diameter slightly larger than the cord 10) drilled on opposite sides on part 22 just below part 30A is tied at one end of cord 10. When the cord is in tension and pulled by the ball 8 in the direction of the arrow T in FIG. 2, the knot of cord within the housing is straightened out and closes push-button 30A providing a signal which can be fed along a cable 34 to the computer. The cable 34 houses the conductors 26, 28 and terminates in a jack plug 36.

The switches 14 and 16 are provided with a jack plug by means of which the output signals from these switches are connected to the computer. The jack plug is inserted in a connection panel 42 mounted to the base 2. The switch 18 is connected directly to the connection panel 42. The output from the base to the computer is therefore fed from the outputs accumulated by this panel 42 and the joystick 4. The base 2 is provided with a cable in order to allow the various signals from the joystick controller 4 and the switches 12, 14, 16 and 18 to be coupled to the computer (not shown). The base 2 may also be coupled to the computer by infrared means. A suitable computer for the purpose of this game machine is an IBM PC/XT or a compatible computer with display screen. However, it will be appreciated that any type of computer capable of processing the signals and providing an output visual display may be adopted for the purpose.

The manner in which the machine that has been described can be used to play a game or practice golf shots will now be described with reference to the flow diagram of FIG. 4 which represents a program run by the computer.

At the start of the program as shown at block 50 the player is presented with three options on the display screen of the computer. He may calibrate the machine, he may play a game or he may leave the program. Interaction between the computer and the player is via the button 16 which is used to select an appropriate option. If the calibrate option is selected, data relating to the machine are stored in the computer. The data required to be preset onto the computer for play of the game include the length of the cord 10, the angle of the ramp of the base and the maximum angular sweep of the joystick control stick 6.

If the player selects the "play" option he is given a further option of either practicing or playing a simulated game. If the practice option is selected the player is able to obtain feedback about the drives he makes. Initially the player places the ball 8 on the starter button 14. He uses button 16 to indicate to the computer that a stroke is about to be played. When the ball is struck, the computer receives a 'start' signal from the closing or triggering of the switch in button 14. This starts a timer in the computer. The timer is stopped when the computer receives a signal from the closing or triggering of the switch 12 which occurs as soon as the cord 10 is extended tautly as shown on the left hand side in FIG. 1. Immediately on receipt of the signal from the switch 12 the computer records the position in two dimensions of the control stick 6 of the joystick controller 4. With this data representing the time and position of the ball, the computer calculates the velocity of the ball in space as well as data about the trajectory the ball is following and the maximum distance of the drive. These results are displayed on the display screen (not shown) associated with the computer. In this way the player is able to obtain accurate feedback as to the extent of any defects in his stroke. This allows correction of the player's stroke and improvement to be monitored.

Instead of practicing, the player may select to play a simulated game. In this case, he will be asked at block 60 to choose from a selection of golf courses pre-programmed into the computer. Each course comprises nine or eighteen holes to be played. Each hole is played by the player by at least one initial drive followed by a series of putts. Depending on the length of the initial drive, the computer will calculate the length of the remaining putt or drive and indicate this to the player on the display screen. Each drive required is played with the tethered ball 8. However, when a putt is to be played, the tethered ball is replaced with a normal free golf ball. Success in a putt is recorded by means of the closing of the microswitch 18 in the base of the hole 17 on the base 2. Each putt is restricted by a time limit of 60 seconds. If the initial drive results in a long putt, the computer divides this up into a series of short putts. The display screen indicates how many putts are required. In order to succeed, the player must satisfactorily complete each of this series of putts by closing the microswitch 18 each time with the free golf ball. From the number of drives made and the number of successful putts and the time taken for the putting operation, the computer calculates a score for the player for each hole.

Figure 4A:
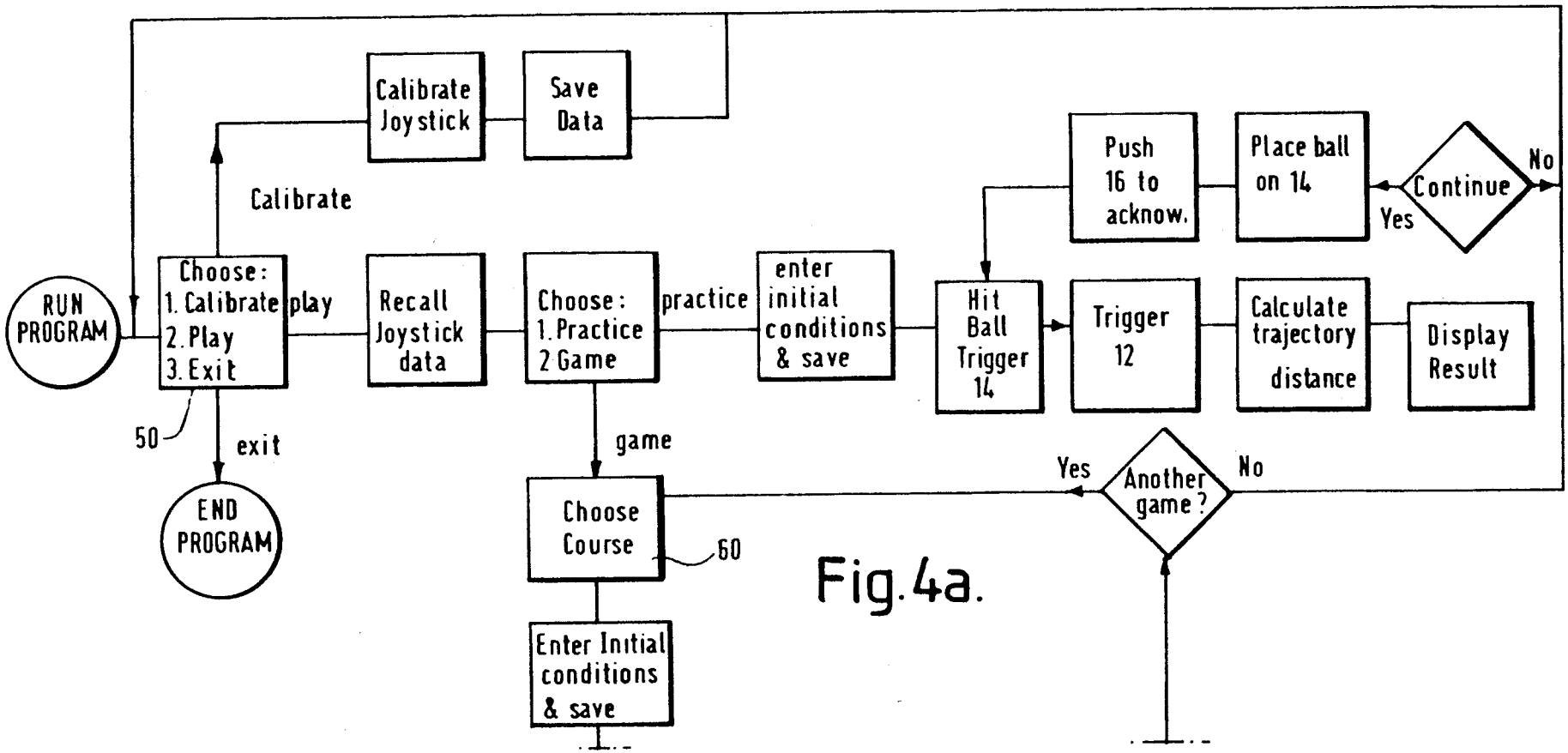
FIGS. 4*a* and 4*b* are flow diagrams illustrating one embodiment of the program run by the computer during operation of the machine.
Figure 4B:
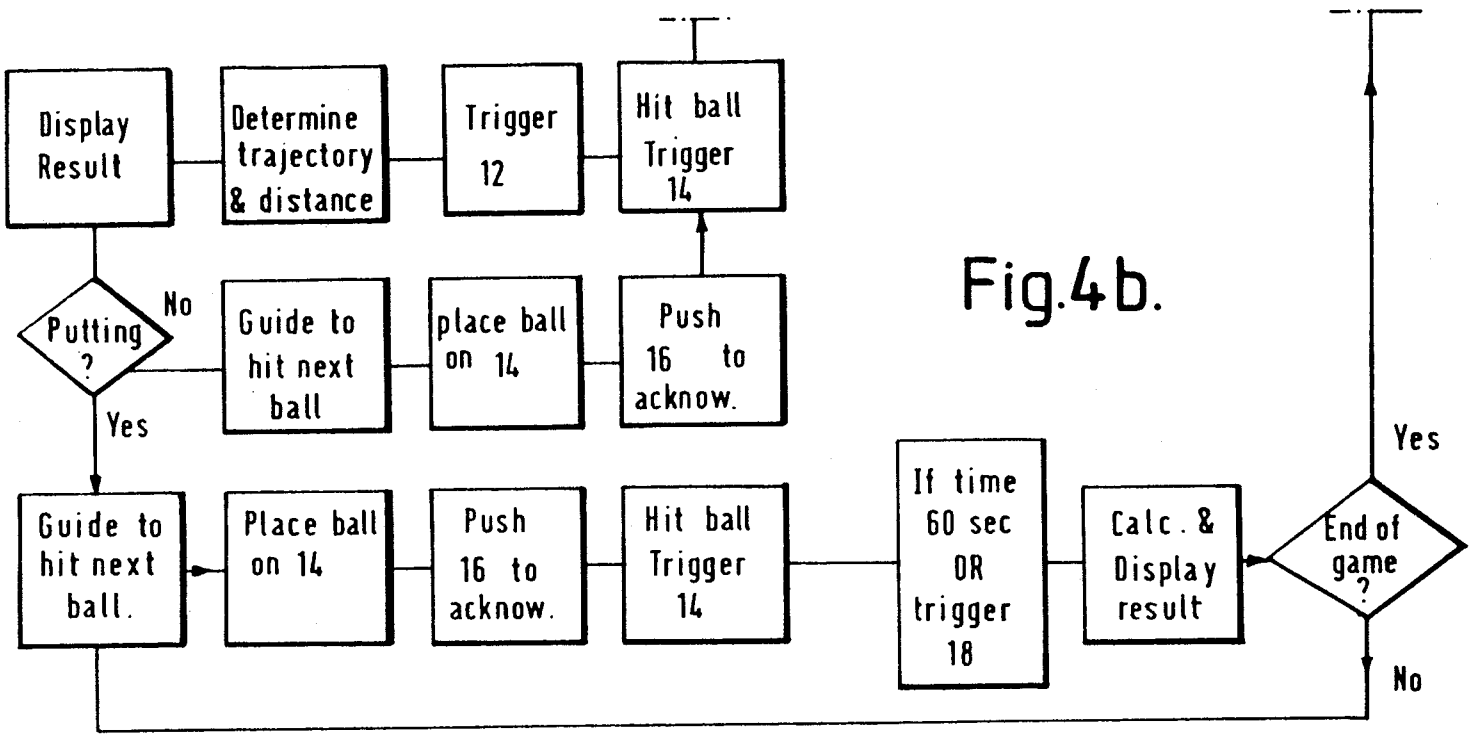

In the flow diagram of FIG. 4 references are made to the triggering of switches 12, 14, 16 and 18. Such triggering represents the closing of the contacts of the relevant switch to provide an input signal to the computer to initiate the next stage of the program.

It will be appreciated that the game machine described using the combination of a golf ball tethered by means of cord to the control stick of a joystick controller, the cord comprising a switch which is closed when the cord is taut, allows stimulating golf practice to be performed.

I claim:

1. A golf game comprising a ball tethered to a pivotable control means of a controller, first switch means incorporated in the tethering means, processing means and display means, the arrangement being such that when the tethering means is taut, as at a point during the drive of the ball, the first switch means is triggered to cause data on the position of the control means to be fed to the processing means which determines the trajectory and distance of the drive and displays this information on the display means.

2. A game according to claim 1, wherein the first switch means is 'pull-to-close' contact switch.

3. A game according to claim 1, wherein the pivotable control means is a control stick of a joystick controller.

4. A game according to claim 1, wherein the ball is tethered by means of a cord.

5. A game according to claim 4, wherein the cord is non-elastic.

6. A game according to claim 4, wherein the length of the cord is such that the normal trajectory of the ball is not unnecessarily restricted during the drive.

7. A game according to claim 1, comprising a base simulating a green on a golf course formed with a hole and provided with second switch means which is triggered to send a signal to the processing means when the ball contacts it upon entry into the hole.

8. A game according to claim 7, wherein the processing means includes a timer which is initiated when the ball is struck.

9. A game according to claim 8, wherein the timer is stopped when the first or second switch means is closed or triggered.

10. A game according to claim 8, wherein the timer is initiated by a third switch means which is closed or triggered when the ball on it is removed.

11. A game according to claim 7, wherein the processing means is arranged to determine the length of the remaining putt or drive and display this information on the display means.

12. A game according to claim 7, wherein the processing means determines a score for the number of drives made and the number of successful putts where the ball is holed and the time taken for the putting operation.

13. A game according to claim 1 or claim 7, comprising a fourth switch means to allow a player to interact with the processing means at the start of the play.

* * * * *